United States Patent [19]

Vayre et al.

[11] Patent Number: 4,470,028

[45] Date of Patent: Sep. 4, 1984

[54] MECHANICALLY CONTROLLED SWITCH WITH AUTOMATIC OPENING

[75] Inventors: Roger Vayre, Nanterre; Christian Thomas, Montesson, both of France

[73] Assignee: La Telemecanique Electrique, France

[21] Appl. No.: 440,461

[22] Filed: Nov. 9, 1982

[30] Foreign Application Priority Data

Nov. 9, 1981 [FR] France ..... 81 20924

[51] Int. Cl.[3] ..... H01H 73/64

[52] U.S. Cl. ..... 335/16; 335/6; 335/45; 335/175; 335/176; 200/243

[58] Field of Search ..... 335/6, 16, 38, 41, 42, 335/45, 166, 167, 168, 169, 170, 172, 173, 174, 175, 176; 200/243, 67 PK

[56] References Cited

U.S. PATENT DOCUMENTS 2,721,241 10/1955 Leyhausen ..... 335/6

3,538,477 11/1970 Walters et al. ..... 335/166

3,559,120 1/1971 Myers ..... 335/42

3,605,050 9/1971 Goldman ..... 335/173

3,864,649 2/1975 Doyle ..... 335/173

3,979,675 9/1976 Maier ..... 335/16

*Primary Examiner*—George Andrews

*Attorney, Agent, or Firm*—William A. Drucker

[57] ABSTRACT

A mechanically controlled power switch with automatic opening is provided for limiting short circuits. A switch (13), a breaking chamber (30) which is associated therewith, a coil (50), a striker (51) cooperating therewith, and a lock (53) for holding the power switch in open position S after the appearance of a short circuit are placed in a removable cartridge (23) provided with connection terminals (37, 55). This switch cartridge is advantageously used in mechanically controlled protection apparatus or in electromagnetic contactor apparatus having their own protection.

5 Claims, 9 Drawing Figures

MECHANICALLY CONTROLLED SWITCH WITH AUTOMATIC OPENING

BACKGROUND OF THE INVENTION

The invention relates to a mechanically controlled switch with automatic opening for a protective limiting device, said switch comprising:

- a housing having a breaking chamber provided with fins for fractioning the arcs,
- a power switch placed in this chamber and having at least one fixed contact and a mobile contact which is actuated by a pushbutton and which is subjected to the action of a fixed pressure spring tending to apply it against the fixed contact,
- a coil which is serially connected with the switch in a circuit and is adapted to attract a magnetizable striker when the circuit has passing therethrough a short circuit current,
- a control device having a mobile part which cooperates by pushing with the pushbutton to move the mobile contact,
- input and output terminals for the circuit,
- this striker cooperating with this pushbutton so as to move this latter when it is attracted independently of the mobile part, and to bring it into a position where a locking device holds the switch in an open safety position.

Such switches are particularly used in protection apparatus where the power contacts serve at the same time for establishing and for the frequent breaking of the power supply circuits which are usually controlled by contactors.

THE PRIOR ART

In a known apparatus, whose construction complies with the one defined above, no measures are taken for changing the fixed or mobile contacts; such measures, which respond however to one of the constant worries of users, meet in this particular case difficulties due especially to the relative complexity of the device; it is then desirable to make this operation as simple as possible by giving the user means which allow him to carry out such operations rapidly and without the possibility of incorrect assembly.

It is desirable, moreover, to make it possible to change the contacts without it being necessary to separate the terminals of the protection apparatus from the network and from the load and to make available to users a range of contacts whose dimensions as well as those of the coil correspond with the different current intensities and with the different levels of limitation.

SUMMARY OF THE INVENTION

In accordance with the invention, this result is attained because the power switch, the breaking chamber, the coil and the striker, as well as the locking device are placed in a removable insulating cartridge which is placed in the casing of the apparatus and which has externally, on the one hand, two connecting terminals not connected directly to the network or to a user apparatus and between which are placed in series the coil and the switch, and, on the other hand, in a region opposite the breaking chamber: one end of the pushbutton adapted to cooperate with the mobile part of the control device, and one end of the locking device adapted to communicate a movement when the switch is held in the open safety position, guiding and holding means being provided on this cartridge to ensure proper positioning thereof and communication of this movement.

BRIEF DESCRIPTION OF THE DRAWINGS

The invention, as well as other complementary arrangements, will appear more clearly from the following detailed description.

In the accompanying drawings.

DESCRIPTION OF THE PREFERRED EMBODIMENT

Figure 2:
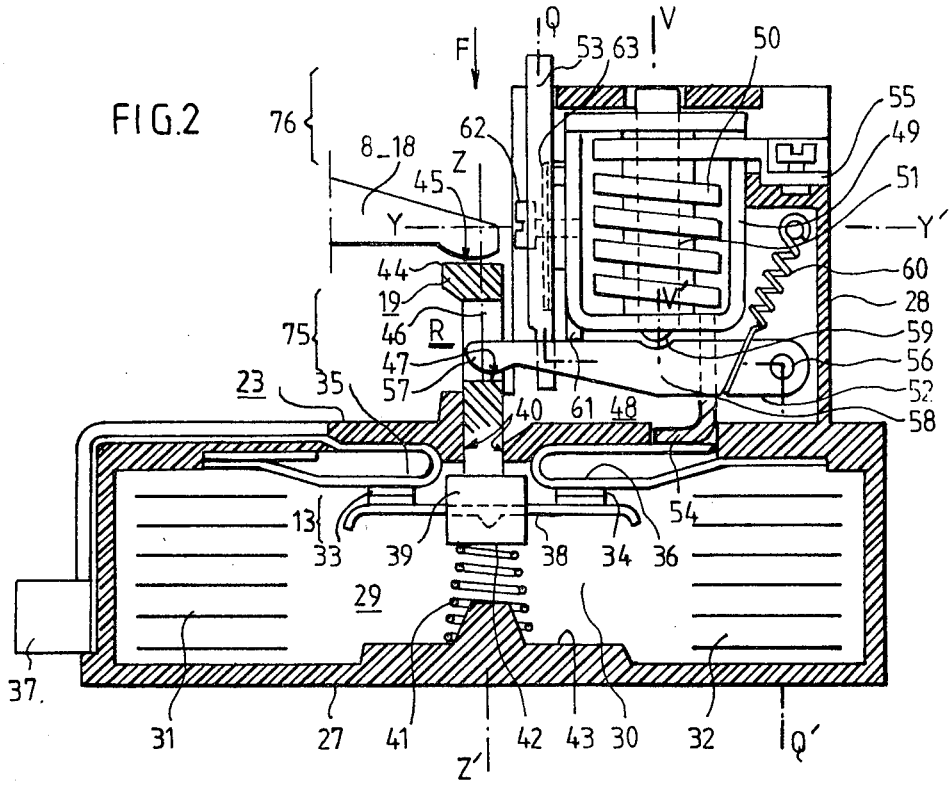
FIG. 2 shows in elevational view, in section through a median plane PP', a cartridge provided with a double breaking switch in the "closed" position.

The limiting switch which will be described below may be used in a protection apparatus such as shown schematically at 1 in FIG. 1*a*; this apparatus comprises principally in a case 2 an automatic switch 3 whose emergency opening, should a faulty current, more especially a short circuit, appear, is operated by means of a coil 4 placed in series with the switch between an input terminal 5 connected to network R and an output terminal 6 connected to a load C, and a manual control device 7 whose operation produces rapid opening or closing of the switch through a mobile control part 8 acting on a pushbutton 9 of the switch, whereas a fault signalling member 10 associated with the switch acts on the manual control device 7 to give it, when a fault appears, a particular state which interrupts the action of the control device and confirms the automatic opening. This limiter switch may also be used in a contactor apparatus having additional current limiting (possibly circuit breaking) functions shown schematically at 11 in FIG. 1*b*; like the preceding one, this latter apparatus comprises a case 12, a switch 13 and a coil 14 placed in series between the terminals 15, 16 similar to those of switch 3, but in which the repeated closing and opening control is effected by means of an electromagnet 17 whose mobile control part 18 cooperates with the pushbutton 19 of the switch 13, whereas the fault signalling member 20 acts directly or indirectly on a control contact 21 placed in series with the coil 22 of the electromagnet so as to confirm, should the case arise, the automatic safety opening de-energization of this electromagnet.

Additional terminals 25, 26 here serve for applying a control signal to the electromagnet.

In one or other of the possible applications, the switch 3, 13 which is contained in a removable insulating cartridge 23 separable from case 1, 11 may be a single break or a double break switch and it is clear that the number of cartridges used in an apparatus correspond to that of the number of phases of the network.

The insulating cartridge 23, as well as its contents, are better shown in FIG. 2 where it can be seen that it has the general shape of an L having a first leg 27 and a second leg 28 which are substantially perpendicular.

The first leg 27 contains a first volume 29 in which are disposed the switch 3 respectively 13 and a breaking chamber 30 which is associated therewith and which comprises, in a way known per se, fins 31, 32 for fractionating the arcs.

This switch comprises in the example shown, two fixed contacts 33, 34 which are carried by bent conductors 35 respectively 36, one of which extends as far as a first connection terminal 37 external to the cartridge; a mobile bridge contact 38 is carried by a mobile contact holder 39 which may move along an axis ZZ' by means of guide surfaces 40 of the cartridge. The mobile contact as well as the contact holder are subjected to the action of a fixed compression spring 41 which tends to close the switch by bearing on an internal end 42 of the contact holder and on a wall 43 of the cartridge.

Because of the bent shape of conductors 35, 36 repulsion forces develop on the mobile contact bridge 38 which moves parallel thereto.

A second end 44 of the contact holder 39, opposite the first end, is placed externally of the first volume and has a first bearing surface 45 directed towards spring 41 and an elongated opening 46 having a second bearing surface 47 also directed towards the spring.

The second leg 28 contains a second volume 48 in which are disposed, on the one hand, a magnetizable yoke 49, a coil 50 which is associated therewith and a magnetizable striker 51 of the plunger core type and, on the other hand, a transmission lever 52 and a locking lever 53.

The ends of coil 50 are connected, on the one hand, to the bent conductor 36, for example by means of a flexible conductor 54 and, on the other hand, to a secnd external connection terminal 55. The striker, which assumes a rest position shown in FIG. 2 (for example by means of a spring not shown), may move along an axis VV' which is also that of coil 50 and which is substantially parallel to the axis ZZ'.

The transmission lever 52 which moves in a median plane PP' of the cartridge through a pivot or pin 56 whose axis is perpendicular to this plane, has a free end 57 which penetrates into the elongated opening 46 of the contact holder 39 so as to be able to cooperate with the second bearing surface 47, and a central portion 58 placed opposite one end 59 of the striker; a return spring 60 associated with this transmission lever for resiliently maintaining it against fixed stop 61 in a rest position R which is that shown in FIG. 2.

The locking lever 53 rocks about a pivot 62 whose axis YY' is parallel to the median plane PP' or passes therethrough; this axis YY' is substantially perpendicular to the axis VV' of the coil. A return spring 63, placed for example about pivot 62, communicates to this locking lever 53 an anticlockwise torque K, shown in particular in FIG. 3, which causes it to apply a first end 64 against lateral face 65 of the transmission lever and which gives to a second end 66 of the locking lever 53, outside the second volume, a particular position I.

It will be noted that the transmission lever 52 is placed between the first volume 29 and the coil 50 and that the outer end 44 of the contact holder forming a pushbutton, moves in the vicinity of the second leg 28 of the cartridge in a region 75 opposite the breaking chamber 30, whereas the outer end 66 of the locking lever 53 moves at the end of this second leg 28 in a region 76 also opposite the breaking chamber.

The cartridge 23 is preferably formed by associating together two insulating half cases 67 and 68 (see FIG. 3) which are applied to each other along a joint plane merging with the median plane PP' and are held in contact, either by resilient hooks integrally moulded with the half cases, or by means of external metal clips or else by means of rivets.

Figure 7:
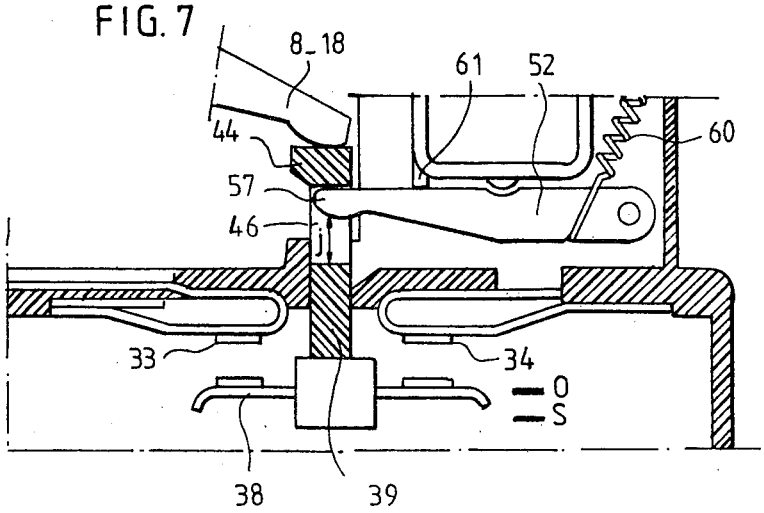
FIG. 7 shows the apparatus of FIG. 2 in the open controlled state of the switch.

When the switch is to be opened and placed in position O (see FIG. 7), the contact holder 39 receives on its first bearing surface 45 a thrust in direction F which is conveyed thereto by a part 8, 18 of the mechanical (7, FIG. 1*a*) or electromagnetic (17, FIG. 1*b*) control device; because there exists a clearance (j, FIG. 7) between the end 57 of the transmission lever 52 and the second bearing surface of the elongated opening 46, this movement has not effect on the transmission lever; the switch closes again under the effect of spring 41 when the action on the contact holder 39 ceases. When the switch is in the closed position and a very high current flows in the coil, striker 51 is attracted by the coil and the yoke and pushes back the transmission lever 52, against the action of its return spring 60, so that its end 57 exerts on the second bearing surface 47 an action for the emergency opening of the contacts of the switch.

Figure 4:
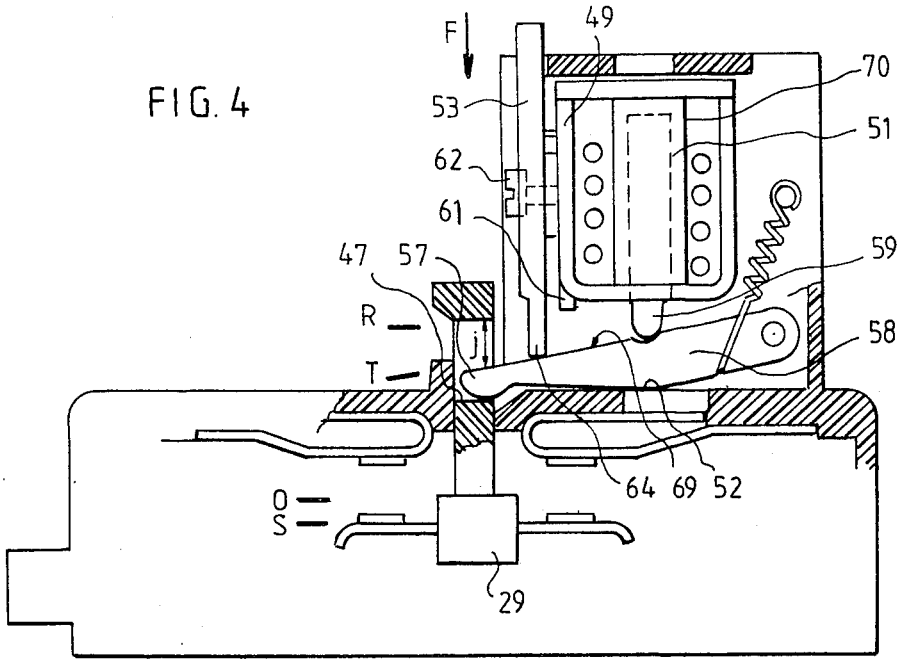
FIG. 4 shows an elevational view of the cartridge, with local section, the switch being in the open safety position.
Figure 5:
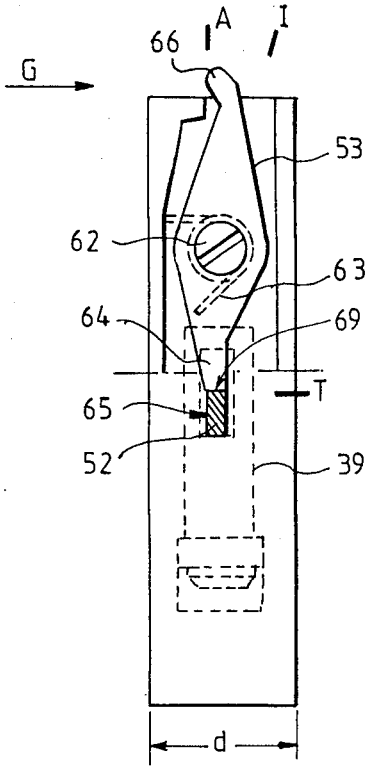
FIG. 5 shows a side view of the cartridge with a local section through the plane QQ' when the switch is in the open safety position.

As soon as the transmission lever reaches or exceeds the working position T, shown in FIGS. 4 and 5, in which this current will have been sufficiently limited, the internal end 64 of the locking lever passes above an edge 69 of the transmission lever 52 so as to hold it in this position T where the switch is now in the open safety condition S.

During this operation, the locking lever 53 assumes an active position A, shown in FIG. 5, under the effect of its return spring 63.

Figure 1A:
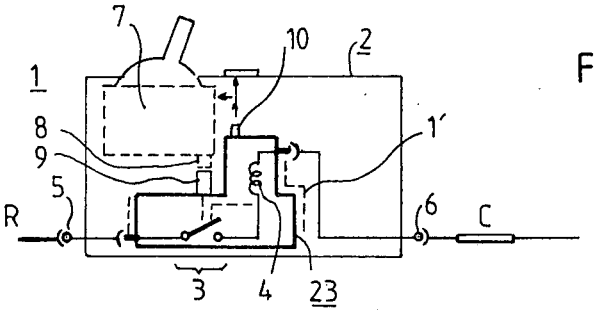
FIGS. 1*a* and 1*b* show schematically two mechanically respectively electromagnetically, controlled protection apparatus in accordance with the invention.
Figure 1B:
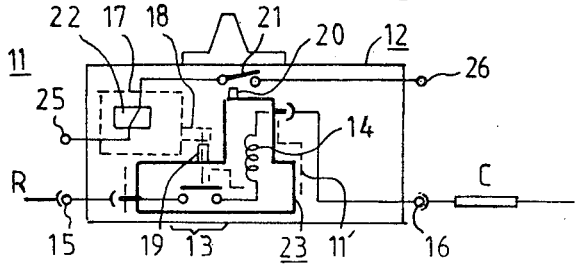
Figure 8:
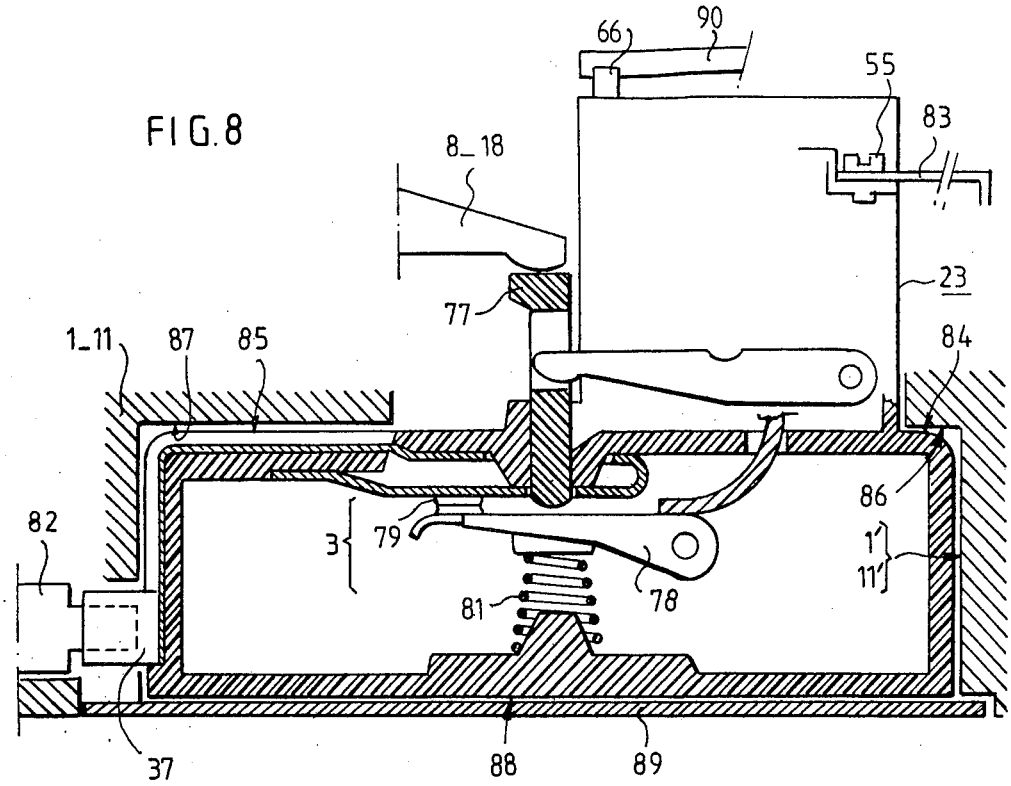
FIG. 8 illustrates a cartridge using a single break switch.

The movement of the outer end 66 of this locking lever is used either for confirming the opening of the switch 3, 13 by means of a mechanical action supplied by the device 7, 8 of FIG. 1*a*, or for opening, directly or not, the switch 20 of the control electromagnet 17, 18 by a transmission member, such as 90, FIG. 8.

In both cases, a particular indication may be delivered for informing the maintenance staff that the automatic opening is due to the appearance of a short circuit current.

As can be seen more especially in FIG. 4, measures may be adopted for the cooperation between the mobile parts placed in the second volume 48 to take place under good conditions. Thus, the stop 61 for the transmission lever 52 and the pivot 62 of the locking lever 53 are both carried by the yoke 49 in which a cylindrical socket 70 serves for guiding the striker 51.

Figure 3:
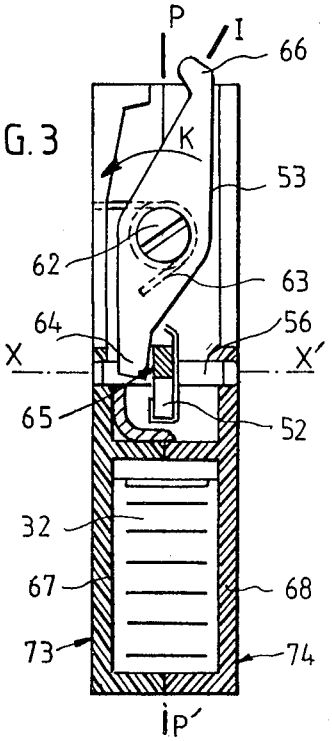
FIG. 3 illustrates a view from the left-hand side of the cartridge in a section through a breaking plane QQ', the switch being closed.
Figure 6:
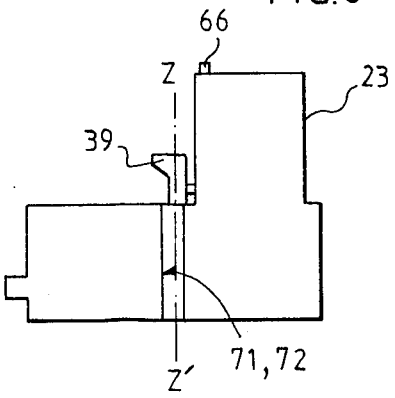
FIG. 6 illustrates an external elevational view of the cartridge.

The cartridge 23 is further guided in the case of the apparatus which receives it by means of grooves 71, 72 parallel to axis ZZ', which are formed in the opposite external faces 73, 74 parallel to the contact holder plane (see FIGS. 6 and 3).

It can be seen in particular from FIGS. 3 and 5 that the cartridge 23 occupies a small width d which allows several of them to be placed side by side in parallel compartments 1', 11' of an apparatus 1 or 11 designed for using them, without for all that resulting in large dimensions.

The contact holder 39 which is shown in the preceding figures and forming a pushbutton may also be replaced by another pushbutton 77 for acting on a mobile single break contact 78, shown in FIG. 8, which is returned by spring 81 and which cooperates with a single fixed contact 79 of switch 3.

In this same figure, it can be seen that the cartridge 23 is maintained in a compartment 1', respectively 11', of the apparatus through the cooperation, on the one hand, of surfaces such as 84, 85 with walls 86, 87 of the case 1, 11 and, on the other hand, of surfaces such as 88 with a lid 89 closing the compartment. In this situation, the external terminals 37, 55 of the cartridge cooperate with the internal terminals 82, 83 of case 1 going towards the connection terminals 5, 6 respectively 15, 16 of the apparatus which receives it, whereas the end 66 of the locking lever transmits its possible movement to a transmission part 90 whose purpose is to disable the mechanical device 7 or the control switch 21 of the electromagnetic device 17.

Resetting of the locking (53) and transmission (52) members is obtained by communicating to the end 66, through manual or automatic control means not described, a movement in direction G, see FIG. 5.

We claim:

1. A switching apparatus comprising:

a-an insulating casing;

b-at least one removable insulating cartridge mounted in said casing and, housed in said cartridge;

i-a breaking chamber having fins for fractionating the arcs;

ii-a power switch placed in the breaking chamber and having at least one fixed contact, one mobile contact and a fixedly mounted pressure spring tending to apply the mobile contact against the fixed contact;

iii-circuit means having terminals located outside the casing and, serially connected in said circuit means within the cartridge, the said power switch and a coil;

iv-a magnetizable striker cooperating with said coil for being displaced from a rest to an actuated position when a short circuit current is flowing through the said circuit means;

v-pushbutton means having an outer portion which projects into the casing out of the cartridge and an inner portion cooperating with the mobile contact and displaceable from a rest position in which the power switch is closed to first and second actuated positions in which the power switch is open, the second actuated position being more remote from the rest position than the first actuated position.

vi-and mechanical transmission and locking means, cooperating with the striker in the actuated position of the striker and with the pushbutton means to displace the pushbutton means from its rest position to its second actuated position and to lock the pushbutton means into its second actuated position;

c-control means housed in the casing outside the cartridge and having a mobile control part which cooperates with the outer portion of the pushbutton means to displace it from its rest position to its first actuated position;

d-disabling means, cooperating with the said mechanical transmission and locking means when the striker is in its actuated position for disabling the said control means; said cartridge and said casing having cooperating guiding and holding means for positioning the cartridge within the casing, and detachably cooperating electrical connecting means which are part of said circuit means.

2. A switching apparatus as claimed in claim 1, wherein the insulating cartridge is formed by a flat case defining first and second adjacent elongate volumes arranged with the general shape of an L, the breaking chamber being part of the first volume and the coil, the striker and the mechanical transmission and locking means being housed in the second volume.

3. A switching apparatus as claimed in claim 2, wherein the pushbutton means comprises an elongate mobile contact holder which moves parallel to the said second volume.

4. A switching apparatus as claimed in claim 1, wherein the transmission and locking means comprises a transmission lever mounted for rocking motion about a first pivot and having a surface portion which is engaged by the striker in the actuated position of the striker, said pushbutton means having an elongate opening with a bearing surface which is located nearer from the mobile contact than the rest of said opening and the transmission lever having one end opposite the first pivot which engages the said bearing surface when the striker is in its actuated position, the said transmission and locking means further comprising a locking lever mounted for rocking about a second pivot which is substantially at right angles with said first pivot, the said rocking lever having first and second end portions and an actuated position in which the said first end portion locks the transmission lever into the actuated position of the said transmission lever.

5. A switching apparatus as claimed in claim 4, wherein the second end portion of the locking lever constitutes the said disabling means and projects into the casing outside the cartridge for cooperating with the said control means.

* * * * *